US010515769B2

(12) United States Patent
Doro

(10) Patent No.: US 10,515,769 B2
(45) Date of Patent: Dec. 24, 2019

(54) PUSH SWITCH

(71) Applicant: Panasonic Intellectual Property Management Co., Ltd., Osaka (JP)

(72) Inventor: Kunio Doro, Okayama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/071,723

(22) PCT Filed: Mar. 1, 2017

(86) PCT No.: PCT/JP2017/008068

§ 371 (c)(1),
(2) Date: Jul. 20, 2018

(87) PCT Pub. No.: WO2017/154694

PCT Pub. Date: Sep. 14, 2017

(65) Prior Publication Data

US 2019/0027324 A1 Jan. 24, 2019

(30) Foreign Application Priority Data

Mar. 9, 2016 (JP) ..... 2016-046294

(51) Int. Cl.
*H01H 13/14* (2006.01)
*H01H 13/04* (2006.01)
(Continued)

(52) U.S. Cl.
CPC ..... *H01H 13/04* (2013.01); *H01H 9/02* (2013.01); *H01H 13/14* (2013.01); *H01H 13/52* (2013.01);
(Continued)

(58) Field of Classification Search
CPC ..... H01H 13/04; H01H 13/14; H01H 13/52; H01H 9/02; H01H 2227/026;
(Continued)

(56) References Cited

U.S. PATENT DOCUMENTS 8,548,395 B2 * 10/2013 Smith ..... H01H 13/14 455/90.2
8,835,787 B2 * 9/2014 Takeuchi ..... H01H 13/06 200/516
2013/0062170 A1 3/2013 Takeuchi et al.

FOREIGN PATENT DOCUMENTS

CN 103000418 A 3/2013
JP 2004-031113 1/2004
(Continued)

OTHER PUBLICATIONS

International Search Report of PCT application No. PCT/JP2017/008068 dated May 16, 2017.
(Continued)

*Primary Examiner* — Vanessa Girardi
(74) *Attorney, Agent, or Firm* — McDermott Will & Emery LLP

(57) ABSTRACT

A push switch according to the present disclosure includes: a case including a recess and having an upper surface located around the recess; a movable member disposed in the recess and including a pressure-receiving portion; a contact portion which switches between ON and OFF by deformation of the movable member; a first sheet including a joining portion which is opposite to the upper surface of the case, a pressing portion located above the pressure-receiving portion, and an intermediate portion located between the joining portion and the pressing portion, the first sheet covering the recess at the pressing portion and the intermediate portion; and a second sheet joined to the first sheet. The joining portion of the first sheet is joined to the upper surface of the case, and the
(Continued)

second sheet is joined to the intermediate portion of the first sheet.

10 Claims, 7 Drawing Sheets

(51) Int. Cl.
*H01H 9/02* (2006.01)
*H01H 13/52* (2006.01)

(52) U.S. Cl.
CPC . *H01H 2205/016* (2013.01); *H01H 2215/004* (2013.01); *H01H 2223/044* (2013.01); *H01H 2227/026* (2013.01)

(58) Field of Classification Search
CPC ..... H01H 2215/004; H01H 2205/016; H01H 2223/044
See application file for complete search history.

(56) References Cited

FOREIGN PATENT DOCUMENTS

| | | |
|---|---|---|
| JP | 2005-019112 A | 1/2005 |
| JP | 2005-251494 | 9/2005 |
| JP | 2013-058380 | 3/2013 |

OTHER PUBLICATIONS

English translation of Chinese Search Report issued in related Chinese Patent Application No. 201780014685.7, dated May 8, 2019.

* cited by examiner

PUSH SWITCH

CROSS-REFERENCE TO RELATED APPLICATIONS

This application is a U.S. national stage application of the PCT International Application No. PCT/JP2017/008068 filed on Mar. 1, 2017, which claims the benefit of foreign priority of Japanese patent application No. 2016-046294 filed on Mar. 9, 2016, the contents all of which are incorporated herein by reference.

TECHNICAL FIELD

The present disclosure generally relates to a push switch and more particularly relates to a push switch in which a contact portion turns ON or OFF by deformation of a movable member.

BACKGROUND ART

A conventionally known push switch has a configuration in which the upper side of a case accommodating a switch contact portion is covered with a protective sheet (for example, refer to Patent Literature (PTL) 1).

The push switch disclosed in PTL 1 includes a case formed in a box shape having an opening in the upper surface. A movable member (movable contact) formed in an upwardly convex dome shape is disposed in a concave portion surrounded by a wall part of the case. The protective sheet is disposed on the case so as to cover the concave portion. The edge portion of the protective sheet mounted on the upper end of the wall part of the case is fixed to the case by welding through laser irradiation.

During operation of this push switch, a downward force is applied to the protective sheet and transmitted to the movable member, causing the movable member to be deformed (elastically reversed) into a downwardly convex shape. With this, the lower surface of the movable member is brought into contact with a center contact formed on the inner bottom surface of the concave portion of the case, and thus the push switch turns ON. When the force is no longer applied to the protective sheet, the movable member is deformed (elastically returns) into the original shape (upwardly convex dome shape), and thus the push switch turns OFF.

CITATION LIST

Patent Literature

PTL 1: Unexamined Japanese Patent Publication No. 2013-58380

SUMMARY OF THE INVENTION

A push switch according to an aspect of the present disclosure includes: a case including a recess and having an upper surface located around the recess; a movable member disposed in the recess and including a pressure-receiving portion; a contact portion which switches between ON and OFF by deformation of the movable member; a first sheet including a joining portion which is opposite to the upper surface of the case, a pressing portion located above the pressure-receiving portion, and an intermediate portion located between the joining portion and the pressing portion, the first sheet covering the recess at the pressing portion and the intermediate portion; and a second sheet joined to the first sheet. The joining portion of the first sheet is joined to the upper surface of the case, and the second sheet is joined to the intermediate portion of the first sheet.

DESCRIPTION OF EMBODIMENTS

Prior to the description of an exemplary embodiment of the present disclosure, a problem with a conventional device will be briefly described.

There are cases where a conventional push switch produces sound during operation. Usage of the push switch varies; turning down the sound that is produced during operation is preferable depending on the usage.

Hereinafter, a push switch according to an exemplary embodiment of the present disclosure will be described with reference to the drawings. Note that the configuration described below is merely one example of the present disclosure and the present disclosure is not limited to the configuration described below. Thus, various modifications, even other configurations than that described below, can be made in accordance with the design or the like without departing from the scope of the technical idea according to the present disclosure.

Exemplary Embodiment (1) Outline

Figure 1A:
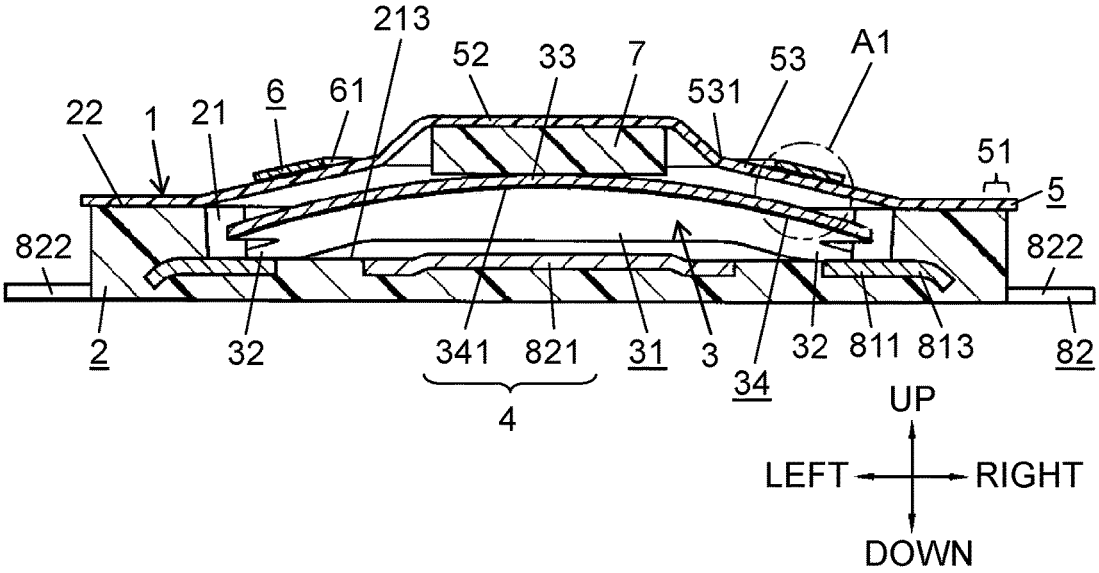
FIG. 1A is a cross-sectional view of a push switch according to an exemplary embodiment of the present disclosure.
Figure 1B:
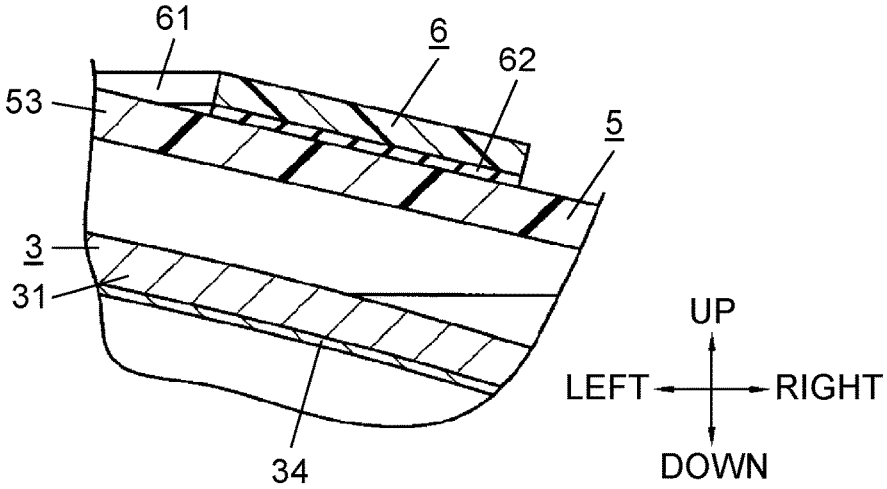
FIG. 1B is an enlarged view of an "A1" part in FIG. 1A.
Figure 2:
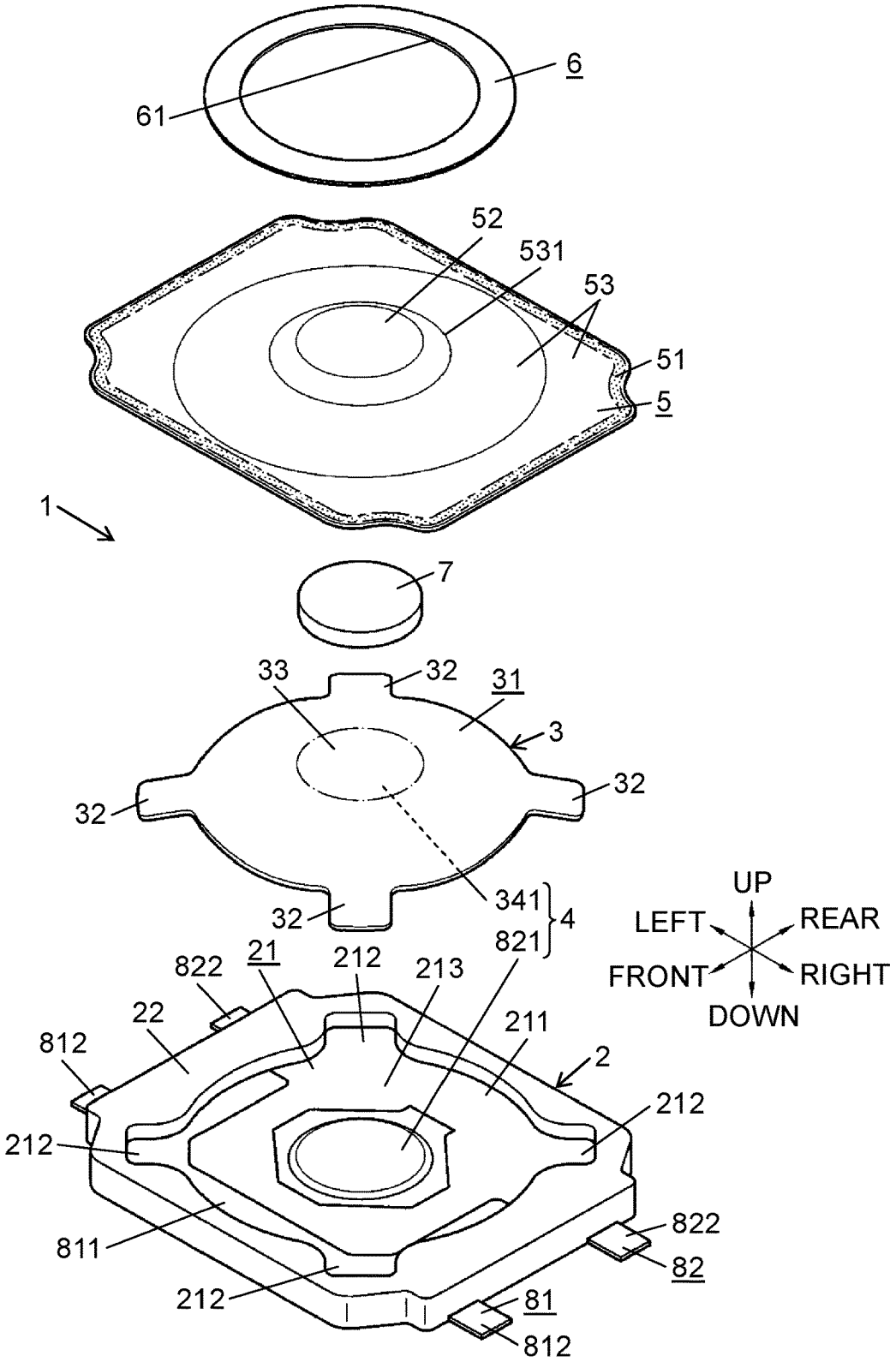
FIG. 2 is an exploded perspective view of a push switch according to an exemplary embodiment of the present disclosure.

As illustrated in FIG. 1A, FIG. 1B, and FIG. 2, push switch 1 according to the present exemplary embodiment includes case 2, movable member 3, contact portion 4, first sheet 5, and second sheet 6. Note that in the present exemplary embodiment, contact portion 4 includes movable contact portion 341 of movable member 3 and second fixed contact portion 821. This configuration is not necessarily limiting as long as contact portion 4 can switch the push switch between ON and OFF.

Case 2 includes recess 21. Movable member 3 includes pressure-receiving portion 33 and is disposed in recess 21.

Contact portion 4 switches between ON and OFF by deformation of movable member 3 as a result of pressure-receiving portion 33 being pressed toward bottom surface 213 of recess 21.

First sheet 5 includes joining portion 51, pressing portion 52, and intermediate portion 53. First sheet 5 covers recess 21 at pressing portion 52 and intermediate portion 53. Joining portion 51 is joined to the periphery of recess 21 of case 2. Pressing portion 52 is opposite to pressure-receiving portion 33. Intermediate portion 53 is located between joining portion 51 and pressing portion 52. Second sheet 6 is joined to at least intermediate portion 53 of first sheet 5.

Here, first sheet 5 is a flexible sheet made of synthetic resin, for example. Joining portion 51 of first sheet 5 is joined to upper surface 22 of case 2. Note that as is clear from FIG. 1A and FIG. 2, upper surface 22 is located around recess 21. Recess 21 is covered by pressing portion 52 and intermediate portion 53 of first sheet 5. A space in which movable member 3 is housed is present between first sheet 5 and bottom surface 213 of recess 21. Thus, when pressing portion 52 of first sheet 5 is pressed from the end opposite to movable member 3 (downward in FIG. 1), pressure-receiving portion 33 is pressed via first sheet 5 accordingly by deformation of first sheet 5; thus, movable member 3 is deformed. In other words, in push switch 1, movable member 3 disposed in recess 21 is deformed by being pressed via first sheet 5. Contact portion 4 turns ON/OFF by deformation of movable member 3. It is sufficient that pressing portion 52 be located opposite to pressure-receiving portion 33; another member (for example, pressing body 7) may be interposed between pressing portion 52 and pressure-receiving portion 33. Specifically, it is sufficient that pressing portion 52 and pressure-receiving portion 33 be positioned opposite to each other; the force applied to pressing portion 52 may be transmitted to pressure-receiving portion 33 via another member (for example, pressing body 7).

There are cases where push switch 1 of this type produces sound (hereinafter referred to as "operation sound") during operation. In particular, for example, when movable member 3 is a thin member formed in a dome shape and is configured to be reversed during operation, the operation sound may be produced, for example, by the reverse operation of movable member 3, restoration of movable member 3, or collision between movable member 3 and case 2. There are various causes of the operation sound, and the inventors found that one of the causes of the operation sound is vibration of first sheet 5. Specifically, since first sheet 5 covers recess 21 in the state where movable member 3 is housed in recess 21, there are cases, for example, where impact generated during the revere operation of movable member 3 is transmitted to first sheet 5, and thus first sheet 5 vibrates, producing the operation sound.

In push switch 1 according to the present exemplary embodiment, second sheet 6 can suppress the vibration of first sheet 5. When the vibration of first sheet 5 is suppressed, the operation sound of push switch 1 can be kept small. Second sheet 6 is joined to first sheet 5, at intermediate portion 53 located between joining portion 51 and pressing portion 52. Intermediate portion 53 is a main vibration region, and since second sheet 6 is joined to intermediate portion 53, the mass of the vibration region increases by as much as the mass of second sheet 6 and thus, the natural vibration frequency of first sheet 5 changes so that the vibration of first sheet 5 is suppressed. In this way, second sheet 6 functions as a vibration damping member which suppresses the vibration of first sheet 5. Thus, in the present exemplary embodiment, the operation sound due to the vibration of first sheet 5 is suppressed. As a result, in push switch 1 according to the present exemplary embodiment, the sound (operation sound) produced during operation can be kept small.

(2) Details

Push switch 1 described below is used, for example, in an operation unit of various devices such as mobile information terminals and home appliances. For example, push switch 1 is mounted on a printed board and in this state is installed in the housing of a device. In this case, for example, an operation button is disposed in a position corresponding to push switch 1. With this, when a user presses the operation button, push switch 1 is indirectly operated via the operation button.

In the subsequent description, unless otherwise stated, a surface of case 2 on which recess 21 is formed refers to the upper surface of case 2, and the depth direction of recess 21 refers to the "up-and-down direction". Furthermore, a direction in which first terminal 812 and second terminal 822 to be described later project from case 2 refers to the "left-and-right direction", and a direction orthogonal to both the up-and-down direction and the front-and-back direction (direction orthogonal to the drawing sheet of FIG. 1A) refers to the front-and-back direction. Specifically, upward, downward, leftward, rightward, forward, and backward directions are defined as denoted by the arrows "UP", "DOWN", "LEFT", "RIGHT", "FRONT", and "BACK" in FIG. 1A, etc. Note that these directions are not intended to define a direction in which push switch 1 is to be used. The arrows indicating the directions in the drawings are provided for illustrative purposes only; actual directions may differ.

(2.1) Configuration

As shown in FIG. 1A to FIG. 4B, push switch 1 according to the present exemplary embodiment includes pressing body 7, first metal member 81, and second metal member 82, in addition to case 2, movable member, 3, contact portion 4, first sheet 5, and second sheet 6. Furthermore, unless otherwise stated, push switch 1 that is not being operated, that is, push switch 1 that is not being pressed, will be described below. Note that FIG. 1A is a cross-sectional view taken along line X1-X1 in FIG. 4A.

Case 2 is made from synthetic resin and has electrical insulating properties. Case 2 is in the shape of a cuboid that is flat in the up-and-down direction. Recess 21 is formed on upper surface 22 of case 2 that is one surface in the thickness direction of case 2. Recess 21 includes: first region 211 that is opened into the shape of a circle; and four second regions 212 projecting outward from the outer rim of first region 211. The center of first region 211 matches the center of upper surface 22. Four second regions 212 are arranged at equal intervals in the circumferential direction of first region 211 in such a way as to project from the outer rim of first region 211 toward the four corners of upper surface 22. Each of four second regions 212 is opened into a rectangular shape. First region 211 and four second regions 212 are continuous. Thus, upper surface 22 of case 2 includes recess 21 shaped to protrude from the circular depression (first region 211) toward the four corners. Note that case 2 is shaped to have four chamfered corners in a top view. However, chamfering is not essential to push switch 1 and can be omitted as appropriate.

Each of first metal member 81 and second metal member 82 is an electrically conductive metal plate and is held by case 2. First metal member 81 and second metal member 82 are integrated with case 2, for example, by insert molding. First metal member 81 includes first fixed contact portion 811 and a pair of first terminals 812. First fixed contact portion 811 is located in a central area in the left-and-right direction of first metal member 81, and the pair of first terminals 812 are located at both ends in the left-and-right direction of first metal member 81. Second metal member 82 includes second fixed contact portion 821 and a pair of second terminals 822. Second fixed contact portion 821 is located in a central area in the left-and-right direction of second metal member 82, and the pair of second terminals 822 are located at both ends in the left-and-right direction of second metal member 82. First metal member 81 and second metal member 82 are arranged side by side in the front-and-back direction; in the present exemplary embodiment, first metal member 81 is positioned in front of second metal member 82.

First fixed contact portion 811 and second fixed contact portion 821 are exposed from bottom surface 213 of recess 211. First fixed contact portion 811 is exposed in an outer peripheral portion of first region 211, and second fixed contact portion 821 is exposed in a central area of first region 211. First fixed contact portion 811 is also exposed in two front-side second regions 212 among four second regions 212. A circular region of second fixed contact portion 821 projects upward from bottom surface 213 of recess 21, and the remaining region of second fixed contact portion 821 and first fixed contact portion 811 are formed flush with bottom surface 213.

The pair of first terminals 812 and the pair of second terminals 822 project from both surfaces in the left-and-right direction of case 2. Specifically, one of first terminals 812 and one of second terminals 822 project leftward from the left side surface of case 2. The other of first terminals 812 and the other of second terminals 822 project rightward from the right side surface of case 2. The lower surface of each of the pair of first terminals 812 and the pair of second terminals 822 is formed flush with the lower surface of case 2. The pair of first terminals 812 and the pair of second terminals 822 are mechanically coupled and electrically connected to electrically conductive members on the printed board by soldering, for example.

First fixed contact portion 811 and the pair of first terminals 812 are electrically connected to each other via a portion of first metal member 81 that is embedded in case 2. Likewise, second fixed contact portion 821 and the pair of second terminals 822 are electrically connected to each other via a portion of second metal member 82 that is embedded in case 2. First metal member 81 and second metal member 82 are electrically insulated from each other.

Movable member 3 is disposed in recess 21 of case 2. Movable member 3 includes an elastic plate material, for example, a metal plate made of stainless steel (SUS) or the like. Movable member 3 has a shape corresponding to recess 21 so as to fit in recess 21 and is formed one size smaller than recess 21. Specifically, movable member 3 includes: main body 31 corresponding to first region 211 of recess 21; and four leg portions 32 corresponding to four second regions 212 of recess 21. Main body 31 is formed in the shape of a circle. Four leg portions 32 are arranged at equal intervals in the circumferential direction of main body 31 so as to project outward from the outer rim of main body 31. Each of four leg portions 32 is in a rectangular shape. Main body 31 and four leg portions 32 are continuous. Movable member 3 is housed in recess 21 in such a way that main body 31 fits within first region 211 and four leg portions 32 fit within four second regions 212 of recess 21.

Main body 31 is formed in a dome shape curved so that a central area thereof is convex upward. Four leg portions 32 project diagonally downward from the outer rim of main body 31. Therefore, in the state where movable member 3 is housed in recess 21, movable member 3 is in contact with bottom surface 213, only at leading ends of four leg portions 32, and is separated from bottom surface 213, in the area other than the leading ends of four leg portions 32 (refer to FIG. 1A). The central area of main body 31 forms pressure-receiving portion 33 of movable member 3. In other words, in movable member 3, the central area of main body 31 functions as pressure-receiving portion 33 which receives the force applied from the outside of push switch 1 to push switch 1 during operation of push switch 1 (hereinafter referred to as "operation force").

Conductive layer 34 having electrical conductivity is formed throughout the entire lower surface of movable member 3 by gold (Au) plating or silver (Ag) plating, for example. A portion of conductive layer 34 that corresponds to the central area (pressure-receiving portion 33) of main body 31 forms movable contact portion 341. Movable member 3 is in contact with bottom surface 213 of recess 21 at at least four leg portions 32. Therefore, conductive layer 34 is electrically connected, at at least one leg portion 32, to first fixed contact portion 811 exposed on bottom surface 213. Furthermore, while a detailed description will be made in the "(2.2) Operation" section, when the operation force is applied to pressure-receiving portion 33, main body 31 changes into a downwardly convex dome shape by the deformation of movable member 3. At this time, movable contact portion 341 formed on the lower surface of pressure-receiving portion 33 contacts second fixed contact portion 821, and thus conductive layer 34 and second fixed contact portion 821 are electrically connected.

Put another way, in the present exemplary embodiment, movable contact portion 341 and second fixed contact portion 821 form contact portion 4. Contact portion 4 switches between ON and OFF by the deformation of movable member 3 as a result of pressure-receiving portion 33 being pressed toward bottom surface 213 of recess 21. Specifically, in the state where pressure-receiving portion 33 is not under the operation force, movable contact portion 341 is separated from second fixed contact portion 821, and thus contact portion 4 is OFF. At this time, first metal member 81 and second metal member 82 are electrically insulated, and thus there is no electrical conduction between the pair of first terminals 812 and the pair of second terminals 822. In contrast, when movable contact portion 341 contacts second fixed contact portion 821 by the operation force acting on pressure-receiving portion 33, contact portion 4 turns ON. At this time, first metal member 81 and second metal member 82 are electrically connected via conductive layer 34, and thus there is electrical conduction between the pair of first terminals 812 and the pair of second terminals 822.

Here, the movable distance of movable contact portion 341 is the stroke length of push switch 1. Specifically, the stroke length of push switch 1 increases with an increase in the distance from movable contact portion 341 to second fixed contact portion 821 in the state where pressure-receiving portion 33 is not under the operation force. In the present exemplary embodiment, four leg portions 32 project from main body 31; thus, the distance from movable contact portion 341 to second fixed contact portion 821 is greater, meaning that the stroke length is greater, in the configuration including four leg portions 32 than in the configuration not including four leg portions 32.

First sheet 5 is a flexible sheet made of synthetic resin, for example. Here, first sheet 5 is made from a resin film having heat resistance and electrical insulating properties. First sheet 5 is disposed on the upper surface 22 side of case 2 so as to cover the whole of recess 21. First sheet 5 is joined to upper surface 22 of case 2 and thereby covers the surface opening of recess 21 so that the interior of recess 21 is sealed. Thus, first sheet 5 prevents water, flux, and the like from entering the interior of recess 21, for example, and functions as a protective sheet which protects contact portion 4 and movable member 3 housed in recess 21 from water, flux, and the like. The external shape of first sheet 5 is substantially the same as the external shape of upper surface 22 of case 2 and is one size larger than upper surface 22. Specifically, first sheet 5 is in a rectangular shape.

More specifically, first sheet 5 includes joining portion 51, pressing portion 52, and intermediate portion 53. First sheet 5 is joined to upper surface 22 of case 2, at joining portion 51. First sheet 5 covers recess 21 at pressing portion 52 and intermediate portion 53.

Figure 3:
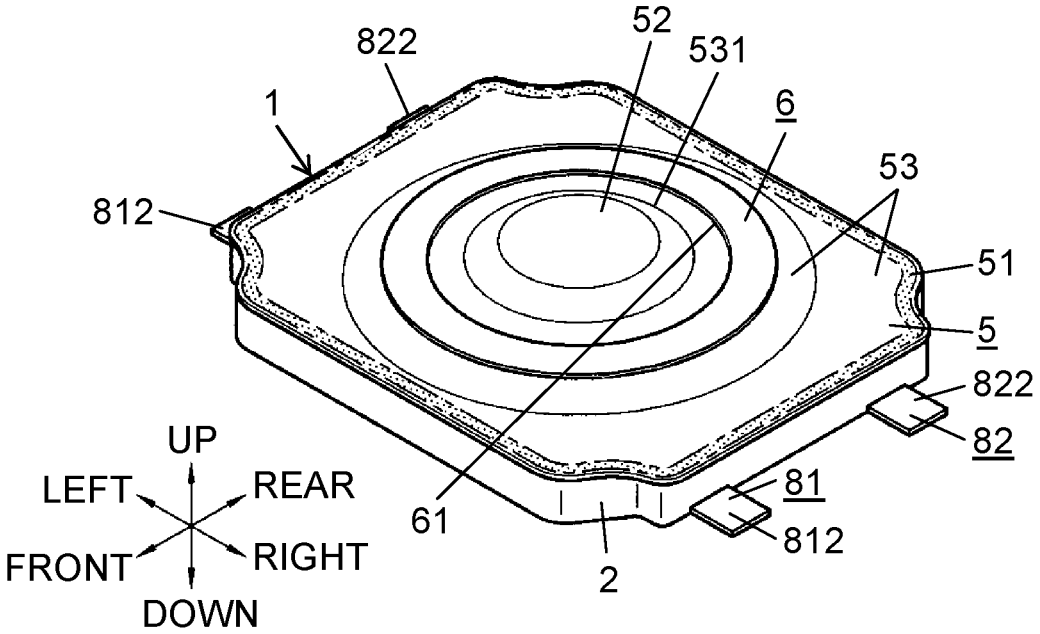
FIG. 3 is a perspective view of a push switch according to an exemplary embodiment of the present disclosure.
Figure 4A:
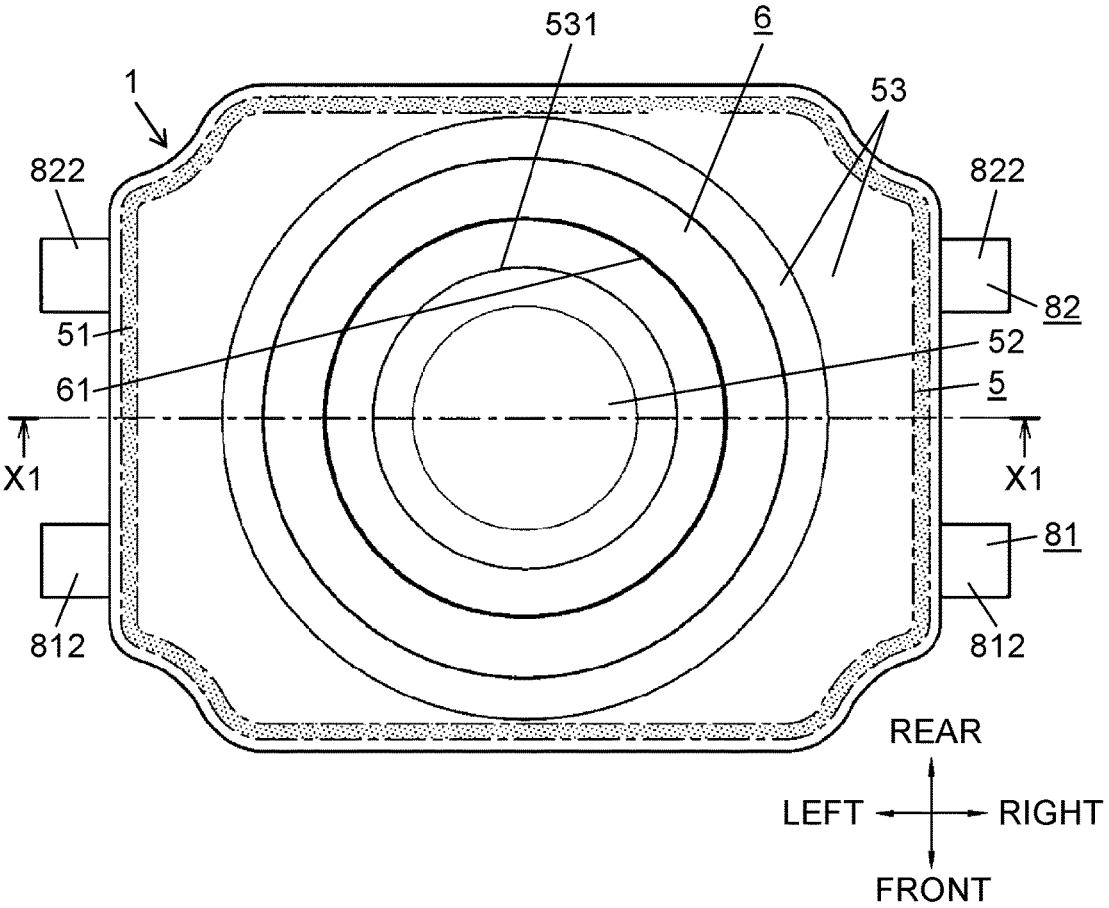
FIG. 4A is a plan view of a push switch according to an exemplary embodiment of the present disclosure.
Figure 4B:
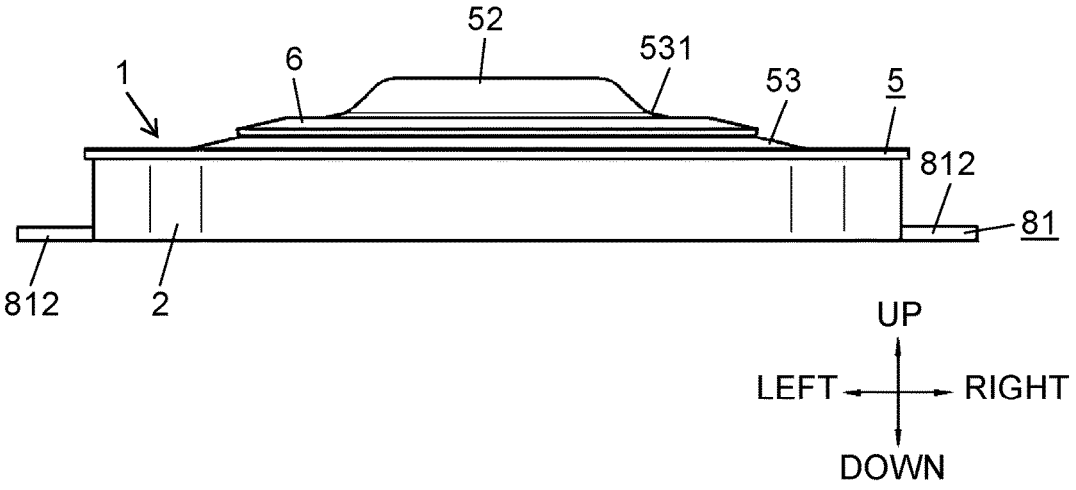
FIG. 4B is a front view of a push switch according to an exemplary embodiment of the present disclosure.

Joining portion 51 is joined to the periphery of recess 21 on upper surface 22 of case 2. Here, joining portion 51 is provided in a flat area of first sheet 5 that is a frame-like portion serving as the outer edge thereof and is located parallel to upper surface 22 of case 2. Joining portion 51 is a linear region having a predetermined width set along the outer edge of first sheet 5, in a position located slightly inward from the outer edge of first sheet 5. In FIG. 2, FIG. 3, and FIG. 4A, the shaded areas represent joining portion 51. Joining portion 51 is joined to the periphery of recess 21 of case 2 by welding. Therefore, unlike the configuration in which joining portion 51 and case 2 are joined using an adhesive material, no adhesive material is clinging to the lower surface of first sheet 5. In the present exemplary embodiment, joining portion 51 is joined to the periphery of recess 21 on upper surface 22 by laser welding. Joining portion 51 is joined to case 2 along the entire perimeter of recess 21.

Pressing portion 52 is opposite to pressure-receiving portion 33 of movable member 3. Here, a circular portion of first sheet 5 that is a central area thereof forms pressing portion 52. Pressing portion 52 is a flat area parallel to upper surface 22 of case 2.

Intermediate portion 53 is located between joining portion 51 and pressing portion 52. Here, an annular portion of first sheet 5 that is located between joining portion 51 and pressing portion 52 forms intermediate portion 53. In other words, among portions surrounded by joining portion 51 in first sheet 5, all portions other than pressing portion 52 are intermediate portion 53. In intermediate portion 53, a region having the shape of substantially the same circle as the shape of the opening in first region 211 of recess 21 is raised, in such a way as to be convex upward, from the flat area in which joining portion 51 is provided. In the present exemplary embodiment, at least a part of intermediate portion 53 is separated from movable member 3. Intermediate portion 53 is inclined to upper surface 22 of case 2 in such a way that an inner area (closer to pressing portion 52) is separated further away from bottom surface 213 of recess 21. Furthermore, the angle of inclination of intermediate portion 35 to upper surface 22 is large in the inner area (closer to pressing portion 52) across boundary line 531 that is concentric with the inner rim of intermediate portion 53.

Second sheet 6 is a flexible sheet made of synthetic resin, for example. Here, second sheet 6 is made from a resin film having heat resistance and electrical insulating properties. Second sheet 6 is joined to first sheet 5. Second sheet 6 is joined to at least intermediate portion 53 of first sheet 5. Here, second sheet 6 is joined to a surface of first sheet 5 opposite to recess 21, that is, the upper surface of first sheet 5. Second sheet 6 is formed in a loop having opening 61 in a position corresponding to pressing portion 52. In the present exemplary embodiment, second sheet 6 is formed in a circular loop having an inner diameter larger than the diameter of a circle defined by boundary line 531 of intermediate portion 53 and an outer diameter smaller than the outer diameter of the shape of the opening in first region 211 of recess 21. In other words, second sheet 6 is formed in a shape that surrounds pressing portion 52 of first sheet 5. Furthermore, second sheet 6 is joined to intermediate portion 53, at least in a position corresponding to recess 21. Specifically, second sheet 6 is joined to intermediate portion 53, in a position within the range of the shape of the opening in first region 211 of recess 21.

Second sheet 6 is joined to first sheet 5 by adhesive material 62 (refer to FIG. 1B). Specifically, adhesive material 62 clings to the lower surface of second sheet 6 by application or the like, and second sheet 6 is attached to the upper surface of first sheet 5 via this adhesive material 62. Adhesive material 62 clings to the entire lower surface of second sheet 6, filling the gap between first sheet 5 and second sheet 6. When first sheet 5 is deformed during operation of push switch 1, second sheet 6 is deformed following the deformation of first sheet 5.

While a detailed description will be made in the "(2.2) Operation" section, second sheet 6 functions as a vibration damping sheet which suppresses the vibration of first sheet 5. Therefore, second sheet 6 is preferably made from a material having a large loss coefficient (tan δ) and good vibration damping properties. Furthermore, adhesive material 62 which joins second sheet 6 to first sheet 5 also functions as a vibration damping member which suppresses the vibration of first sheet 5. Specifically, when first sheet 5 vibrates, adhesive material 62 expands and contracts due to the elasticity of adhesive material 62, and thus the vibration energy of first sheet 5 is absorbed by adhesive material 62, allowing the vibration of first sheet 5 to be suppressed.

Pressing body 7 is disposed between pressing portion 52 of first sheet 5 and pressure-receiving portion 33 of movable member 3. Pressing body 7 is made from synthetic resin and has electrical insulating properties. Pressing body 7 is in the shape of a disk that is flat in the up-and-down direction. Pressing body 7 is disposed above movable member 3 in the state where the lower surface of pressing body 7 is in contact with the upper surface of pressure-receiving portion 33. The upper surface of pressing body 7 is joined to the lower surface of pressing portion 52 by laser welding, for example. Since second sheet 6 is joined to the upper surface of first sheet 5, pressing body 7 and second sheet 6 are joined to the opposite surfaces of first sheet 5.

Pressing body 7 transmits the operation force applied to pressing portion 52 of first sheet 5 to pressure-receiving portion 33 of movable member 3. In other words, when the operation force acts on pressing portion 52 from above, this operation force is transmitted to pressure-receiving portion 33 via pressing body 7 and acts on pressure-receiving portion 33 from above. Thus, when pressing portion 52 is pressed, pressure-receiving portion 33 is indirectly operated via pressing body 7.

(2.2) Operation

Next, the operation of push switch 1 configured as described above will be described.

Push switch 1 is a normally-open switch in which contact portion 4 turns ON only when operated. During operation of push switch 1, pressing portion 52 of first sheet 5 is operated by pressure and thus, a downward operation force acts on pressing body 7 via pressing portion 52. The wording "operated by pressure" indicates an operation in which pressing portion 52 is pressed toward bottom surface 213 of recess 21 (downward).

Figure 5:
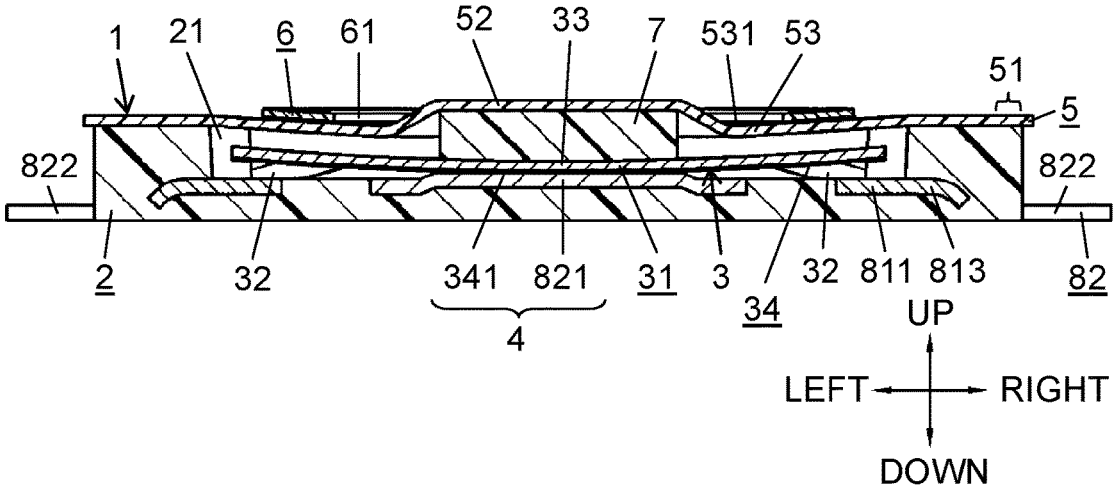
FIG. 5 is a cross-sectional view of a push switch during operation according to an exemplary embodiment of the present disclosure.

When the operation force acts on pressure-receiving portion 33 from above via pressing body 7, pressure-receiving portion 33 is pressed toward bottom surface 213 of recess 21 (downward), and movable member 3 gradually deforms. Subsequently, when the magnitude of the operation force acting on pressure-receiving portion 33 exceeds a predetermined value, movable member 3 largely deforms by buckling, as shown in FIG. 5. At this time, the elastic force of main body 31 acting on pressure-receiving portion 33 rapidly changes, and thus what is called the reverse operation of movable member 3 causes main body 31 to swiftly deform into a dome shape curved so that the central area thereof (pressure-receiving portion 33) is convex downward. Accordingly, a user (operator) who operates push switch 1 by pressure is given a snap feeling (click feeling) along with the deformation of movable member 3. Furthermore, when main body 31 deforms into the downwardly convex dome shape, movable contact portion 341 formed on the lower surface of pressure-receiving portion 33 contacts second fixed contact portion 821, as shown in FIG. 5; thus, contact portion 4 turns ON. In this state, there is electrical conduction between the pair of first terminals 812 and the pair of second terminals 822.

On the other hand, when the operation force acting on pressure-receiving portion 33 is removed in the state where main body 31 is in the downwardly convex dome shape as a result of deformation, the resilience of movable member 3 causes movable member 3 to be restored (deform) into the dome shape curved so that the central area (pressure-receiving portion 33) thereof is convex upward. At this time, the elastic force of main body 31 acting on pressure-receiving portion 33 rapidly changes, and thus main body 31 is restored (deforms) swiftly into the original shape (dome shape curved so that the central area thereof is convex upward). Accordingly, at the time of releasing the operation by pressure, a user (operator) who operates push switch 1 by pressure is given a snap feeling (click feeling) along with the deformation of movable member 3. Subsequently, when main body 31 changes into the upwardly convex dome shape, movable contact portion 341 formed on the lower surface of pressure-receiving portion 33 is separated from second fixed contact portion 821, as shown in FIG. 1A; thus, contact portion 4 turns OFF. In this state, there is no electrical conduction between the pair of first terminals 812 and the pair of second terminals 822.

During operation of push switch 1, the operation sound may be produced, for example, by the reverse operation of movable member 3, the restoration of movable member 3, or the collision between movable member 3 and case 2. There are various causes of the operation sound, and the inventors found that one of the causes of the operation sound is vibration of first sheet 5. For example, there are cases where impact generated during the revere operation of movable member 3 is transmitted to first sheet 5, and thus first sheet 5 vibrates, producing the operation sound.

Push switch 1 includes second sheet 6 functioning as a vibration damping sheet which suppresses the vibration of first sheet 5. Second sheet 6 is joined to intermediate portion 53 of first sheet 5 that serves a main vibration region, and thus efficiently suppresses the vibration of first sheet 5. In other words, out of first sheet 5, joining portion 51 joined to case 2 and pressing portion 52 joined to pressing body 7 do not vibrate much. In contrast, intermediate portion 53 located between joining portion 51 and pressing portion 52 is not joined to either of case 2 and pressing body 7, and thus is more likely to vibrate than joining portion 51 and pressing portion 52. When second sheet 6 is joined to such intermediate portion 53, the mass of the vibration region increases by as much as the mass of second sheet 6 and thus, the natural vibration frequency of first sheet 5 changes so that the vibration of first sheet 5 is suppressed, for example. Note that the change in the natural vibration frequency of first sheet 5 is merely one of the reasons why the vibration of first sheet 5 is suppressed. Second sheet 6 is not limited to the configuration which suppresses the vibration of first sheet 5 by changing the natural vibration frequency of first sheet 5.

(3) Advantages

As described above, push switch 1 according to the present exemplary embodiment includes second sheet 6 joined to at least intermediate portion 53 of first sheet 5. When second sheet 6 suppresses the vibration of first sheet 5, the operation sound due to the vibration of first sheet 5 can be kept small. Thus, push switch 1 has the advantage of being able to keep small the sound (operation sound) produced during operation.

Furthermore, as is in the present exemplary embodiment, second sheet 6 is preferably joined to intermediate portion 53, at least in a position corresponding to recess 21. With this configuration, since second sheet 6 is joined to intermediate portion 53, particularly in a position that is likely to be a vibration region because of being separated from case 2, the advantageous effect of second sheet 6 suppressing the operation sound due to the vibration of first sheet 5 becomes noticeable.

Furthermore, as is in the present exemplary embodiment, second sheet 6 is preferably formed in a loop having opening 61 in a position corresponding to pressing portion 52. With this configuration, since second sheet 6 is provided in an area excluding pressing portion 52 which is to be operated by pressure, it is possible to avoid reduction in the operation touch (snap feeling) due to the operation force being absorbed or diffused by second sheet 6 during operation of pressing portion 52 by pressure. In other words, while keeping the operation sound small by second sheet 6, push switch 1 can provide substantially the same operation touch as that would be given when second sheet 6 is not provided. Note that the loop shape of second sheet 6 is not an essential feature of push switch 1; for example, second sheet 6 does not need to include opening 61.

Furthermore, as is in the present exemplary embodiment, push switch 1 preferably further includes pressing body 7 disposed between pressing portion 52 and pressure-receiving portion 33. With this configuration, since the operation force acts on pressure-receiving portion 33 from pressing portion 52 via pressing body 7, the operation force is more likely to focus on pressure-receiving portion 33 and push switch 1 is easier to operate by pressure as compared to the case where pressing body 7 is not provided. When pressing body 7 is provided, intermediate portion 53 located around pressing portion 52 is separated from movable member 3, and the vibration region of first sheet 5 is enlarged; thus, the advantageous effect of second sheet 6 suppressing the operation sound due to the vibration of first sheet 5 becomes noticeable. Furthermore, as long as second sheet 6 is in the form of a loop having opening 61 in a position corresponding to pressing portion 52, even when second sheet 6 is provided, pressing body 7 and second sheet 6 do not overlap, and thus the total height (the size in the up-and-down direction) of push switch 1 can be kept relatively low. Note that pressing body 7 is not an essential element of push switch 1; pressing body 7 may be omitted.

Furthermore, as is in the present exemplary embodiment, second sheet 6 is preferably joined to first sheet 5 by adhesive material 62. With this configuration, adhesive material 62 which joins second sheet 6 to first sheet 5 also functions as a vibration damping member which suppresses the vibration of first sheet 5. Specifically, when first sheet 5 vibrates, adhesive material 62 expands and contracts due to the elasticity of adhesive material 62, and thus the vibration energy of first sheet 5 is absorbed by adhesive material 62, allowing the vibration of first sheet 5 to be suppressed. Moreover, second sheet 6 can be joined to first sheet 5 in a relatively easy method. Note that adhesive material 62 is not an essential element of push switch 1; second sheet 6 may be joined to first sheet 5, for example, by bonding or welding (laser welding).

Furthermore, as is in the present exemplary embodiment, second sheet 6 is preferably joined to a surface (upper surface in the present exemplary embodiment) of first sheet 5 opposite to recess 21. With this configuration, second sheet 6 can be joined to first sheet 5 after first sheet 5 is joined to case 2, and thus push switch 1 not including second sheet 6 only requires a minimum change, also in the manufacture process.

Furthermore, as is in the present exemplary embodiment, joining portion 51 is preferably joined, by welding, to upper surface 22 of case 2 that is located around recess 21. With this configuration, compared to the case where first sheet 5 is joined to case 2 by the adhesive material, the overlap width of upper surface 22 of case 2 that is located around recess 21 can be made small while the joining strength between first sheet 5 and case 2 is maintained; thus, push switch 1 can be downsized. When joining portion 51 is joined to case 2 by welding, there is no adhesive material clinging to the lower surface of first sheet 5, and the vibration of first sheet 5 cannot be expected to be suppressed by the adhesive material; thus, the advantageous effect of second sheet 6 suppressing the operation sound due to the vibration of first sheet 5 becomes noticeable. Note that joining joining portion 51 to case 2 by welding is not an essential feature of push switch 1; joining portion 51 may be joined to case 2, for example, by the adhesive material or the like.

Furthermore, as is in the present exemplary embodiment, joining portion 51 is preferably a region extending along the outer edge of first sheet 5. With this configuration, the vibration region of first sheet 5 is enlarged, and the vibration frequency of vibrating first sheet 5 is reduced, which may result in the frequency spectrum of sound (operation sound) produced during operation being diffused, leading to suppression of the operation sound.

(4) Variations

Figure 6A:
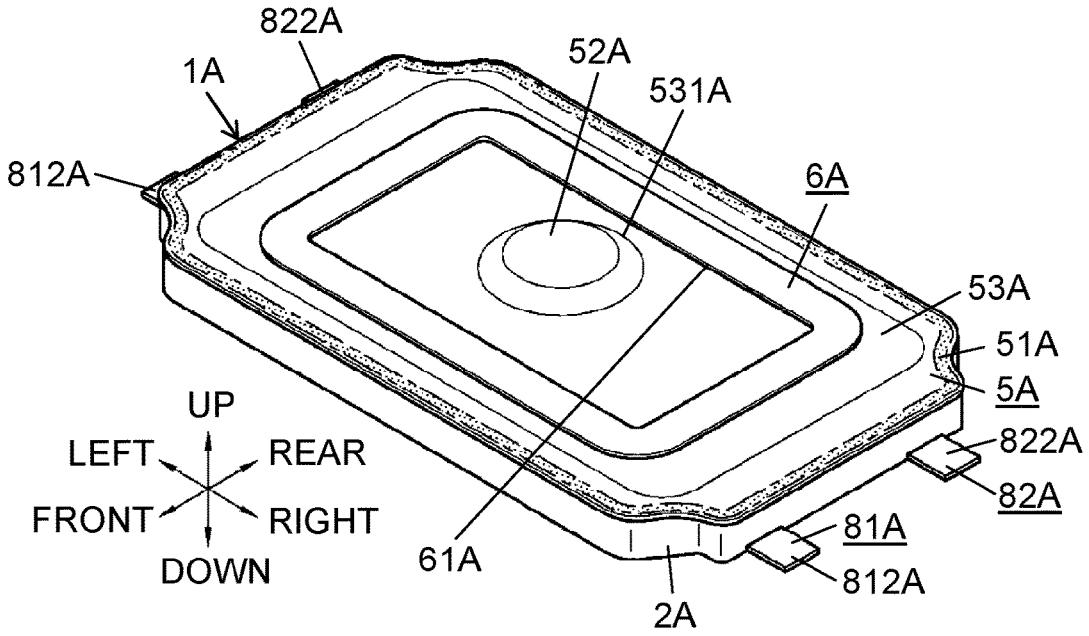
FIG. 6A is a perspective view of a push switch according to a first variation of an exemplary embodiment of the present disclosure.

FIG. 6A illustrates push switch 1A according to the first variation of the above exemplary embodiment. In the first variation, elements corresponding to the elements described in the above exemplary embodiment are assigned with reference marks with "A" added to the ends of those used in the above exemplary embodiment, and description of these elements will be omitted as appropriate; differences from the above exemplary embodiment will be described. In push switch 1A according to the first variation, recess 21A is opened into a rectangular shape, and main body 31A of movable member 3A is formed in a rectangular shape. Furthermore, second sheet 6A is formed in the shape of a rectangular frame following the shape of the opening of recess 21A. Even in push switch 1A having such a configuration, second sheet 6A suppresses vibration of first sheet 5A, and thus the operation sound due to the vibration of first sheet 5A can be kept small.

Figure 6B:
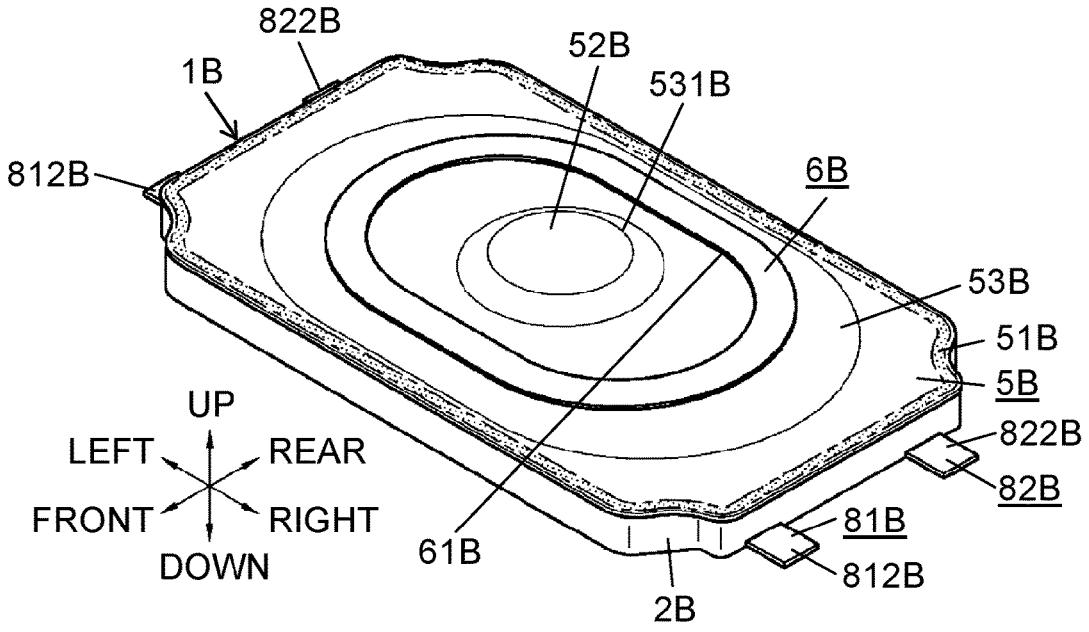
FIG. 6B is a perspective view of a push switch according to a second variation of an exemplary embodiment of the present disclosure.

FIG. 6B illustrates push switch 1B according to the second variation of the above exemplary embodiment. In the second variation, elements corresponding to the elements described in the above exemplary embodiment are assigned with reference marks with "B" added to the ends of those used in the above exemplary embodiment, and description of these elements will be omitted as appropriate; differences from the above exemplary embodiment will be described. In push switch 1B according to the second variation, recess 21B is opened into an oblong shape, and main body 31B of movable member 3B is formed in an oblong shape. Furthermore, second sheet 6B is formed in the shape of an oblong frame following the shape of the opening of recess 21B. Even in push switch 1B having such a configuration, second sheet 6B suppresses vibration of first sheet 5B, and thus the operation sound due to the vibration of first sheet 5B can be kept small.

Hereinafter, variations other than the first variation and the second variation will be described.

The stroke length of push switch 1, that is, the amount of movement of the operation region of first sheet 5 during operation by pressure to turn ON push switch 1 can be set as appropriate. For example, push switch 1 may be of a short stroke type with a relatively short stroke length, may be of a long stroke type with a relatively long stroke length, or may be of an intermediate stroke type which is halfway between the short stroke type and the long stroke type. In particular, the amount of vibration of first sheet 5 increases as the stroke length increases, and thus the advantageous effect of suppressing the operation sound by suppressing the vibration of first sheet 5 with the above-described configuration of push switch 1 becomes noticeable. Furthermore, contact portion 4 of push switch 1 is not limited to that in the present exemplary embodiment and may be of a two-stage operation type with a first contact and a second contact. In push switch 1 of the two-stage operation type, when pressing portion 52 is pressed, the first contact turns ON first, and when pressing portion 52 is further pressed in the state where the first contact is ON, the second contact turns ON. In push switch 1 of the two-stage operation type, movable member 3 is formed by combining two metal plates that buckle with different operation forces, for example.

Furthermore, push switch 1 is not limited to being used in an operation unit of a device and operated by a person, and may be used, for example, in a sensing unit, etc., of a device. In the case where push switch 1 is used in a sensing unit of a device, push switch 1 is used as a limit switch, for example, for detecting the position of a mechanical part such as an actuator.

Furthermore, movable member 3 is not limited to a single-piece plate and may be formed of a plurality of overlapping metal plates. In this case, depending on the number of overlapping metal plates, the magnitude of the operation force necessary for movable member 3 to buckle varies, and the operation touch of push switch 1 varies.

Furthermore, two or more second sheets 6 may be provided. Two or more second sheets 6 may each be formed in a loop, for example, and may be arranged concentrically about pressing portion 52 of first sheet 5. Alternatively, two or more second sheets 6 may be arranged around pressing portion 52 of first sheet 5 so as to surround pressing portion 52. In this case, two or more second sheets 6 are preferably arranged point-symmetrically about pressing portion 52. Note that the arrangement of second sheets 6 does not need to be symmetric; for example, one or more than one second sheet 6 may be arranged in a non-symmetrical pattern around pressing portion 52 of first sheet 5.

Furthermore, pressing body 7 is not limited to being located between pressing portion 52 and pressure-receiving portion 33 and may be disposed, for example, above pressing portion 52. In this case, the lower surface of pressing body 7 is joined to the upper surface of first sheet 5, and pressing body 7 and second sheet 6 are joined to the same surface (in this case, the upper surface) of first sheet 5. With this configuration, the operation force acting on pressing body 7 is transmitted to pressure-receiving portion 33 via pressing portion 52.

Furthermore, covering the whole of recess 21 by first sheet 5 is not an essential feature of push switch 1 as long as first sheet 5 covers recess 21 at pressing portion 52 and intermediate portion 53. For example, a portion of first sheet 5 to which second sheet 6 is joined may have a hole.

Furthermore, second sheet 6 may be joined to a recess 21-end surface of first sheet 5. In other words, although second sheet 6 is joined to the upper surface of first sheet 5 in the above exemplary embodiment, second sheet 6 may be joined to the lower surface of first sheet 5. In this case, when pressing body 7 is disposed between pressing portion 52 and pressure-receiving portion 33, pressing body 7 and second sheet 6 are joined to the same surface (in this case, the lower surface) of first sheet 5. With this configuration, second sheet 6 is not exposed on the surface of push switch 1, resulting in external appearance that matches push switch 1 including no second sheet 6.

Furthermore, intermediate portion 53 does not need to be separated from movable member 3; for example, a part of intermediate portion 53 may be in contact with movable member 3.

SUMMARY

Push switch 1 according to the present exemplary embodiment includes case 2, movable member 3, contact portion 4, first sheet 5, and second sheet 6. Case 2 includes recess 21 and has upper surface 22 located around recess 21. Movable member 3 includes pressure-receiving portion 33. Movable member 3 is disposed in recess 21. Contact portion 4 switches between ON and OFF by deformation of movable member 3. First sheet 5 includes: joining portion 51 which is opposite to upper surface 22 of case 2; pressing portion 52 located above pressure-receiving portion 33; and intermediate portion 53 located between joining portion 51 and pressing portion 52. First sheet 5 covers recess 21 at pressing portion 52 and intermediate portion 53. Second sheet 6 is joined to first sheet 5. Joining portion 51 of first sheet 5 is joined to upper surface 22 of case 2. Second sheet 6 is joined to intermediate portion 53 of first sheet 5.

Furthermore, in push switch 1 according to the present exemplary embodiment, a part (movable contact portion 341) of movable member 3 forms a part of contact portion 4.

Furthermore, in push switch 1 according to the present exemplary embodiment, second sheet 6 is located above recess 21.

Furthermore, in push switch 1 according to the present exemplary embodiment, second sheet 6 has opening 61. Pressing portion 52 of first sheet 5 is opposite to opening 61 of second sheet 6.

Note that push switch 1 according to the present exemplary embodiment may include pressing body 7 between pressing portion 52 of first sheet 5 and pressure-receiving portion 33 of movable member 3.

Figure 7:
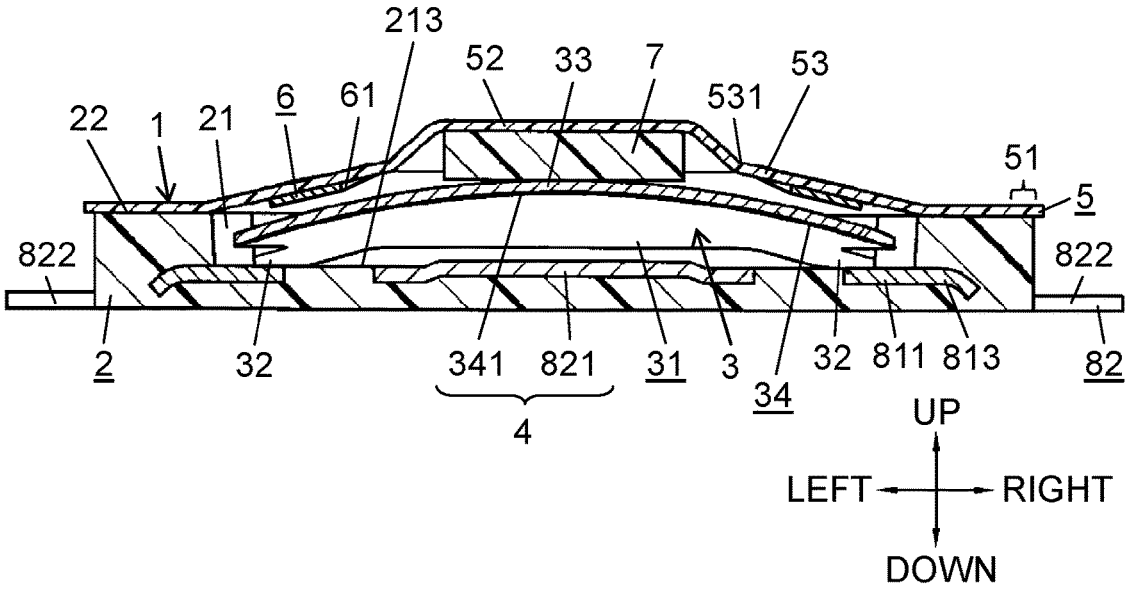
FIG. 7 is a cross-sectional view of a push switch according to another variation of an exemplary embodiment of the present disclosure.

Note that although second sheet 6 is joined to the upper surface of first sheet 5 in the present exemplary embodiment, second sheet 6 may be joined to the lower surface of first sheet 5, as illustrated in FIG. 7.

Note that second sheet 6 may be joined to first sheet 5 by an adhesive material.

Note that joining portion 51 may be joined to upper surface 22 of case 2 by welding.

REFERENCE MARKS IN THE DRAWINGS

1, 1A, 1B push switch
2 case
21 recess
211 first region
213 bottom surface
22 upper surface
3 movable member
31 main body
33 pressure-receiving portion
34 conductive layer
4 contact portion
5, 5A, 5B first sheet
51 joining portion
52 pressing portion
53 intermediate portion
6, 6A, 6B second sheet
61 opening
62 adhesive material
7 pressing body

The invention claimed is:

1. A push switch comprising:

a case including a recess and having an upper surface located around the recess;

a movable member disposed in the recess and including a pressure-receiving portion;

a contact portion which switches between ON and OFF by deformation of the movable member;

a first sheet including a joining portion which is opposite to the upper surface of the case, a pressing portion located above the pressure-receiving portion, and an intermediate portion located between the joining portion and the pressing portion, the first sheet covering the recess at the pressing portion and the intermediate portion; and a second sheet joined to the first sheet, wherein:

the joining portion of the first sheet is joined to the upper surface of the case, and the second sheet is joined to the intermediate portion of the first sheet, the second sheet has an opening, and the second sheet overlaps with the first sheet only at the intermediate portion in plan view.

2. The push switch according to claim 1, wherein a part of the movable member forms a part of the contact portion.

3. The push switch according to claim 1, wherein the second sheet is located above the recess.

4. The push switch according to claim 1, wherein;

the pressing portion of the first sheet is disposed in the opening of the second sheet in plan view.

5. The push switch according to claim 1, further comprising:

a pressing body disposed between the pressing portion of the first sheet and the pressure-receiving portion of the movable member.

6. The push switch according to claim 1, wherein the second sheet is joined to the first sheet by an adhesive material.

7. The push switch according to claim 1, wherein the second sheet is joined to an upper surface of the first sheet.

8. The push switch according to claim 1, wherein the second sheet is joined to a lower surface of the first sheet.

9. The push switch according to claim 1, wherein the joining portion is joined to the upper surface of the case by welding.

10. The push switch according to claim 1, wherein:

the second sheet is flexible, and when the first sheet is deformed, the second sheet is also deformed following deformation of the first sheet.

* * * * *